United States Patent [19]

Bailey et al.

[11] 3,998,279

[45] Dec. 21, 1976

[54] AIR MANIFOLD AND DELIVERY PASSAGEWAYS FOR ROCK DRILL

[75] Inventors: Edward A. Bailey, Newport; George A. Hibbard, Claremont, both of N.H.

[73] Assignee: Joy Manufacturing Company, Pittsburgh, Pa.

[22] Filed: June 21, 1974

[21] Appl. No.: 481,627

Related U.S. Application Data

[63] Continuation of Ser. No. 246,136, April 21, 1972, abandoned.

[52] U.S. Cl. ..... 173/105; 173/78; 173/DIG. 2

[51] Int. Cl.[2] ..... E21C 1/12

[58] Field of Search ..... 173/94–97, 173/73, 78, 80, 104–109, 152, 161–159; 175/122, 171

[56] References Cited

UNITED STATES PATENTS

| | | | |
|---|---|---|---|
| 3,125,361 | 3/1964 | Weaver | 285/137 R |
| 3,157,237 | 11/1964 | Kurt | 173/105 |
| 3,305,249 | 2/1967 | Zahuranec | 285/137 R |
| 3,307,638 | 3/1967 | Kurt | 173/105 |
| 3,406,763 | 10/1973 | Worman | 173/107 |
| 3,453,007 | 7/1969 | Roland | 285/137 R |
| 3,527,482 | 9/1970 | Casterline et al. | 285/137 R |
| 3,666,024 | 5/1972 | Beaumont | 173/105 |
| 3,677,577 | 7/1972 | Krauer et al. | 285/137 R |
| 3,747,632 | 7/1973 | Kok et al. | 285/137 R |

*Primary Examiner*—Ernest R. Purser
*Assistant Examiner*—William F. Pate, III

[57] ABSTRACT

An improved fluid operated rock drill apparatus having all fluid connections thereto secured to the yoke of the drill assembly by a unitary connector means. The yoke is centrally located so that the high pressure fluid being directed to the rock drill hammer piston flows through a path of reduced length resulting in a more efficient operation.

11 Claims, 5 Drawing Figures

AIR MANIFOLD AND DELIVERY PASSAGEWAYS FOR ROCK DRILL

This is a continuation of application Ser. No. 246,136, filed Apr. 21, 1972 and now abandoned.

BACKGROUND OF THE INVENTION

Rock drills are normally powered by compressed air delivered by a plurality of hoses into various chambers for effecting the hammering of a so-called "striking bar" and a rifling arrangement with rachet and pawl assembly to rotate the striking bar when hammering occurs.

Recently developed rock drills have utilized an independent means of rotating the striking bar and a valveless piston control for hammering the striking bar, each powered and controlled by individually located hose connections through a series of elongated interior passageways. The elongated interior passageways do not provide the most efficient operation and the plurality of hose connections have proved to be inconvenient when it is necessary to remove the drill assembly from the drill rigging.

SUMMARY OF THE INVENTION

According to the present invention there is provided a new and novel drill apparatus having a single unitary fluid source connecting means or manifold assembly wherein all hose connections may be concentrated in a centrally located area for convenience in assembly and also resulting in a reduction of length of interior passageways. Removal of the hammer assembly of the drill apparatus is readily accomplished with the novel assembly whereby removal of the single manifold assembly results in removal of all hose connections thereto simultaneously and since all hoses are connected to the central area of the apparatus the backplate may be removed for servicing the internal parts of the drill apparatus without the necessity of disconnecting the bulky hoses.

Other provisions of the present invention will be apparent when taken in conjunction with the following detailed description and the accompanying drawings wherein.

DESCRIPTION

Figure 1:
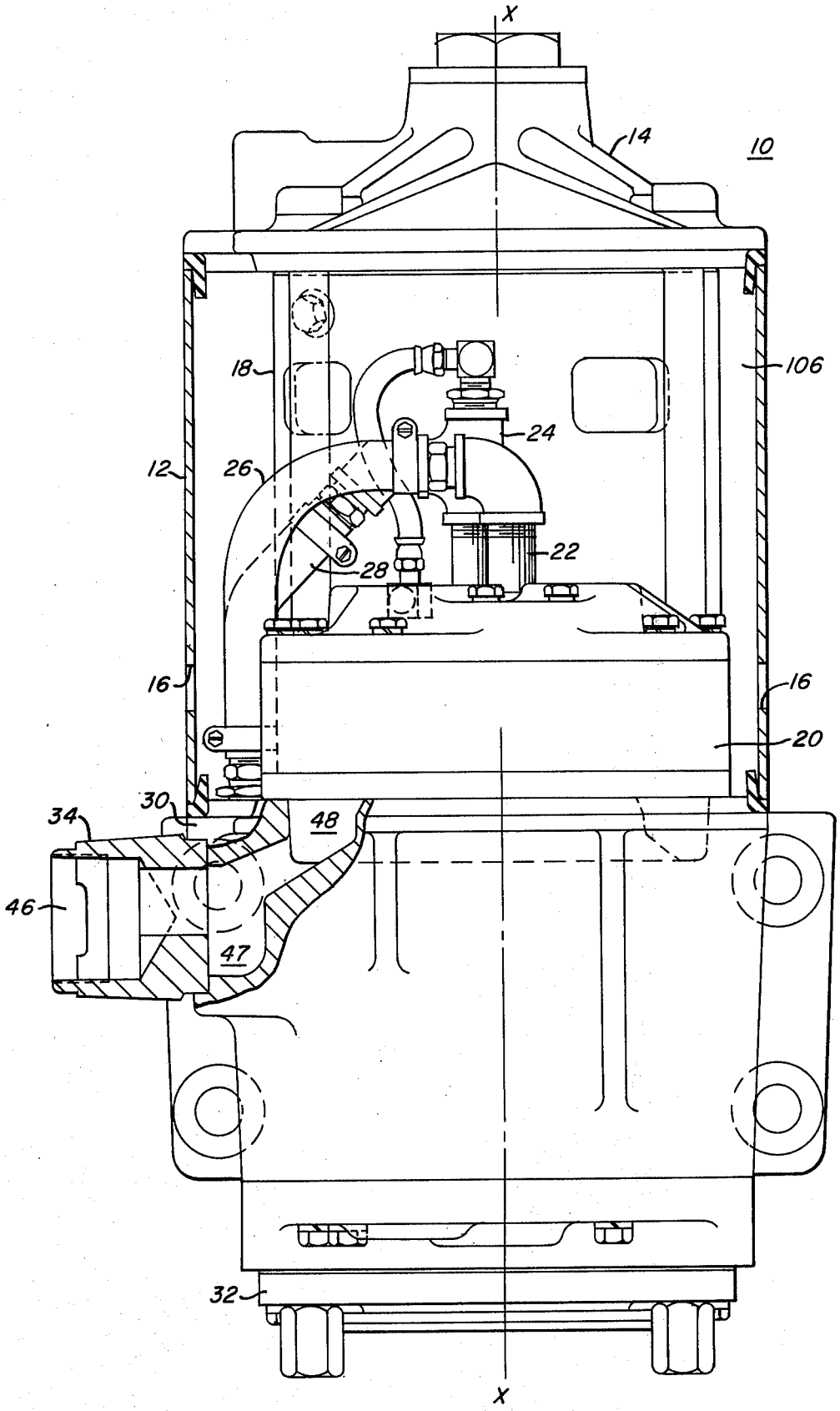
FIG. 1 is a front view partly in section of the drill assembly showing the location of the manifold.

Referring to FIG. 1 there is shown a front outline view of a drill assembly 10 with a container muffler 12 shown in section. As viewed in the drawings the drill assembly 10 includes a backhead or casing head 14, a container muffler 12 with suitable vents 16 encircling both a piston or hammer cylinder 18 and a pneumatically operated independent rotation motor 20. The rotation motor 20 not being pertinent to the present invention is not described in detail herein but is shown in outline form with a plurality of pipe connections 22 and 24 suitably connected by hoses 26 and 28 to passageways (not shown) supplied with compressed air from the hereinafter described manifold. The rotational motor 20 is utilized to rotate a striking bar within the drill assembly for drilling purposes in a well known manner described hereinafter. The drill assembly 10 further includes a yoke 30 coaxially aligned with the hammer cylinder 18 and the backhead 14 with the axis X—X (FIGS. 1 or 3) of the drill assembly 10 and located between the cylinder 18 and a front cap assembly 32. An elongated manifold 34 is secured on a vertical plane at the side of the yoke 30 and is adapted to connect to the external hoses (not shown) to supply air therefrom to internal passageways in the yoke 30 to operate through hoses 26 and 28 the rotational motor and through passageways 46, 47 and 48 (FIG. 1) the drill hammer 36 (FIG. 3) in a manner hereinafter described.

Figure 2:
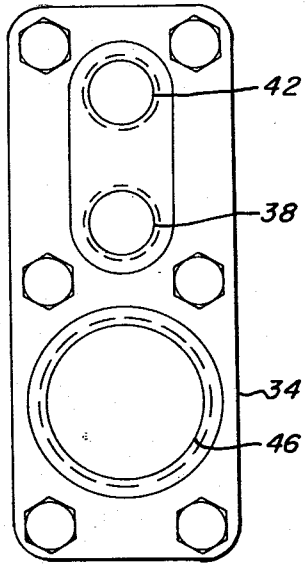
FIG. 2 is an outline view of the manifold.

The manifold or unitary connecting means 34 as shown in the embodiment of FIG. 2 includes three passageways for receiving fluid under pressure, in this embodiment said fluid being compressed air delivered to the rotation motor via the passage 38, internal passageways (not shown); hose 28, and pipe connection 24 for driving the rotation motor 20 in a forward direction; and passage 42, internal passageways (not shown), hose 26 to the pipe connection 22 leading to rotation motor 20 to drive said motor in a reverse direction. A passage 46 in the manifold 34 receives the supply air to be delivered through internal passageways to a collector annulus 48 in the top portion of the yoke 30 of the drill assembly 10.

The piston cylinder 18 (FIG. 3) has an inside diameter substantially equal to the outside diameter of a cylinder liner 50 such that the cylinder liner 50 is very closely fitted within the cylinder 18. Similarly, a buffer ring 52 in very closely fitted within the cylinder liner 50. A cylindrical coaxial bore 54 within the buffer ring 52 receives the hammer means 36 having a piston head portion 58 on one end and an elongated stem 60 extending away from the piston head through the bore 54 to a percussion end 62 for intermittent engagement with the usual coaxial striking bar 63 extending through the yoke 30. The cylinder 18, the cylinder liner 50, the buffer ring 52 and the stem 60 are all cylindrically closely fitted one within the other to form a jacket arrangement whereby ports and passages in each individual element may be selectively in communication with each other without leakage to surrounding areas. The hammer means 36 is slidably positioned within the buffer ring 52 in an axial movement in accordance with the supply of fluid under pressure in lower chamber 64 on the lower or stem side 66 of the piston head 58 or the top chamber 68 on the upper or backhead side 70 of said piston head as fluid under pressure is supplied alternately to the piston chambers 64 and 68 in which said piston head 58 is reciprocally axially moved in an up and down motion whereby the hammer means 36 strikes the striking bar 63 with the percussion end 62 thereof on each down stroke responsive to pressurization of the top chamber 68. Pressurization of chambers 64 and 68 is accomplished by the ports and passages in the mentioned jacket arrangement. The liner 50 is provided with a plurality of diametrically opposite feed grooves 74 and 76, each extending on the outer periphery thereof from the central portion thereof axially, groove 76 to the bottom chamber 64 and groove 74 to the top chamber 68. The groove 74 is connected at one end by a port 78 to the top chamber 68, and at the opposite end by a port 80 to a supply port 82 through the buffer ring 52 to the bore 54. The groove 76 is connected at one end by a port 84 to the bottom chamber 64, and at the opposite end by a port 85 to a supply port 86 through the buffer ring 52 to the bore 54. A delivery groove 88 is formed in the bore 54 into the buffer ring 52 and connected by a passageway 90 to the collector annulus 48. The supply ports 82 and 86 and delivery groove 88 are all aligned perpendicular to the axis X—X with the delivery groove 88 being positioned closely equidistant between the associated ports 82 and 86 at a predetermined length along a plane parallel to axis X—X. A connecting groove 92 of a width at least equal to said predetermined length between said delivery groove 88 and the associated ports 82 and 86 is formed in the stem 60 and positioned to selectively connect the delivery groove 88 to either one of the supply ports 82 or 86 in accordance with the positioning of the drill hammer 36 in its different positions as shown in FIGS. 3 and 4.

A guide stem 94 extends from the backhead 14 into a central bore 96 of the drill hammer 36 to guide said drill hammer 36 and provide a stabilizing effect during its hammering operation. A blow air passage is provided if necessary within the guide stem 94 by a pipe 98 extending from an opening (not shown) in the backhead 14 through the guide stem 94, drill hammer 36 and to a bore 100 in the striking bar along the previously mentioned axis X—X. An exhaust groove 102 is formed in the inside surface of the cylinder liner 50 closely midway between the bottom chamber 64 and the top chamber 68, said exhaust groove 102 being connected by port 104 through the cylinder liner 50 and cylinder 18 to an exhaust chamber 106 surrounding the cylinder 18.

In operation, fluid under pressure is supplied from a source (not shown) by suitable hoses (not shown) for rotation motor control and hammer piston control, all of said hoses being connected to the single centrally located manifold 34. From the manifold 34, the fluid under pressure for motor control is supplied via the hoses 26 and 28 to pipes 22 and 24 (FIG. 1). The fluid under pressure for hammer control is supplied directly from the manifold 34 through passages 46 and 47 to the collector annulus 48 (FIG. 3) through a short passageway 90 in the buffer ring 52 to delivery groove 88, thence to connecting groove 92 which is selectively connected to either supply port 82 or 86 dependent on the location of the drill hammer 36.

Figure 3:
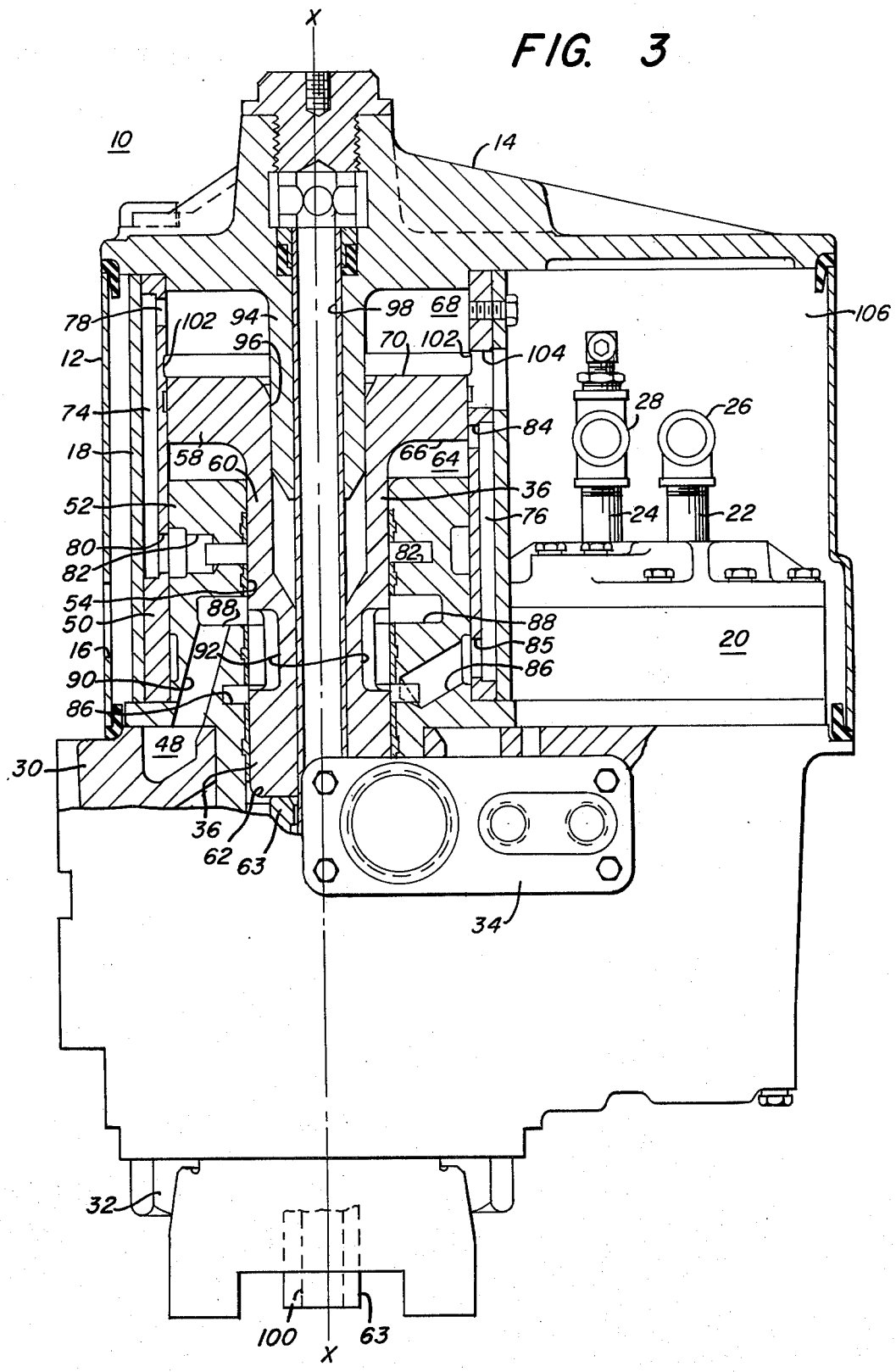
FIG. 3 is a side view partly in section of the drill assembly showing the drill hammer at the end of a downstroke motion.
Figure 4:
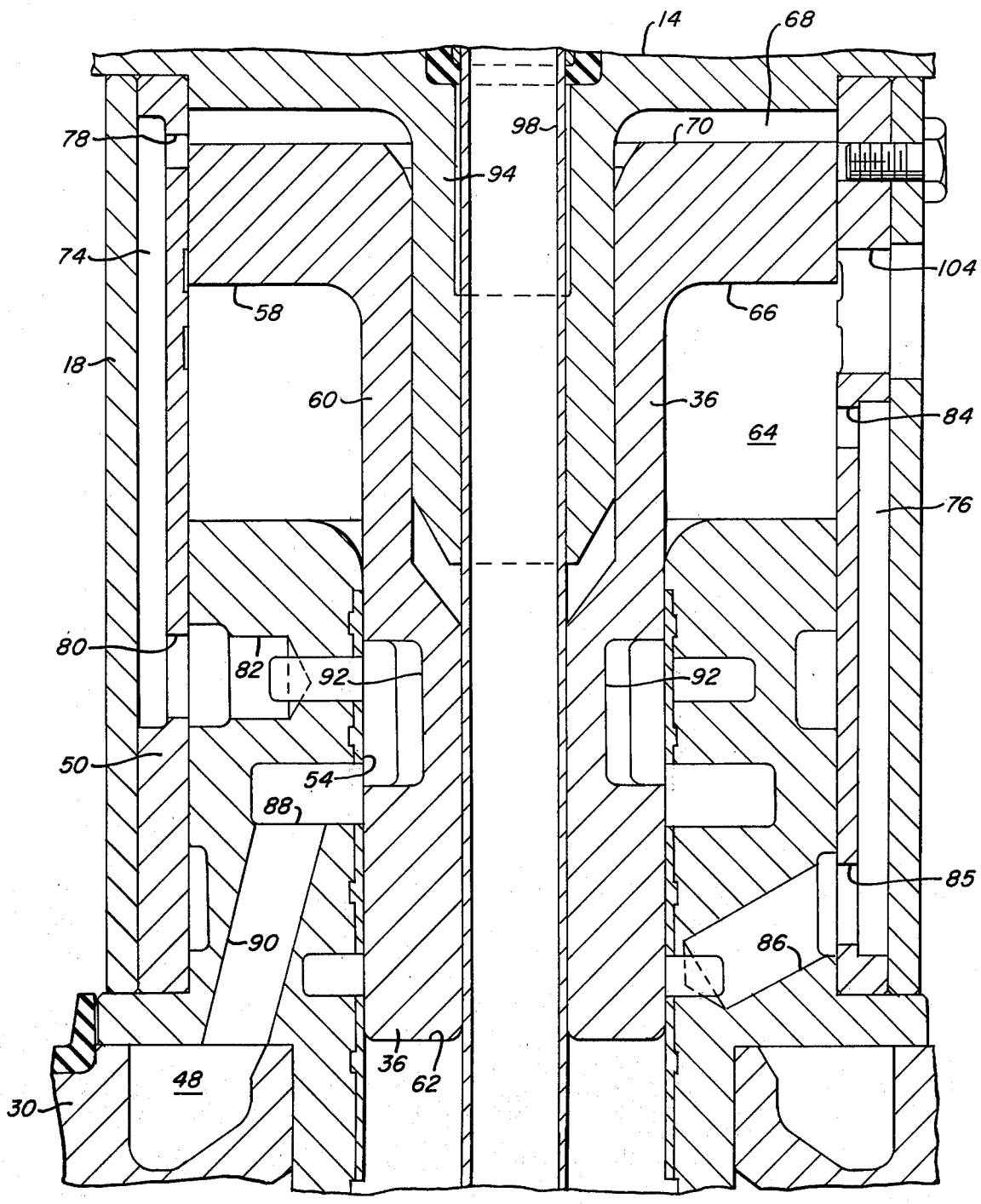
FIG. 4 is a sectional view of a drill hammer at the end of an upstroke motion.

As shown in FIG. 3 with the hammer 36 in its down position, the connecting groove 92 interconnects the delivery groove 88 to the supply port 86 such that fluid under pressure is supplied via the feed groove 76 to port 84 and lower chamber 64 to act on the stem side 66 of the piston head 58 to move the piston head 58 and hammer 36 upward in the up stroke movement. The top chamber 68 is vented to atmosphere via port 104 during the major portion of upward movement of the hammer 36. As the hammer 36 continues to move upward, communication between the connecting groove 92 and the supply port 86 is interrupted, however, the momentum of the moving hammer 36 along with expansion of fluid under pressure in the lower chamber 64 keeps the hammer 36 moving upward during which movement the exhaust communication from top chamber 68 through port 104 is shut off by the piston head 58. Further upward movement of the hammer 36 begins to compress the air under low pressure in top chamber 68 to cushion and rebound the piston 58 as it approaches the end of its upward stroke. Near the end of the upstroke of the hammer 36, the lower chamber 64 is opened to exhaust at port 104 and the connecting port 92 registers with the supply port 82 to supply fluid under pressure therein from the delivery port 88 through port 82 to feed groove 74 and port 78 into the top chamber 68 to act on the backhead side 70 of the piston head 58 thereby starting the down stroke of the hammer 36 (FIG. 4). It can be seen that with the supply of fluid under pressure into top chamber 68 and the expansion of the fluid therein acting on the backhead side 70 of the piston head 58 and with the lower chamber 64 offering very little resistance being that it is open to atmosphere through port 104, downward movement of the hammer 36 is rapid and with a substantial force to cause the percussion end 62 to impact with the striking bar 63 (FIG. 3) to provide the desired effect for drilling by a connected drill steel (not shown). During the downward movement of the hammer 36 from the position shown in FIG. 4 the following occurs: the downward movement of the stem 60 moving the connecting grooves 92 downward interrupts the communication between delivery port 88 and supply port 82 thereby interrupting supply of fluid under pressure to the top chamber 68, the downward movement of the piston head 58 interrupts the communication of lower chamber 64 to atmosphere at port 104 and the air entrapped in chamber 64 begins to compress sufficiently enough to slightly cushion the extreme downstroke motion of the piston head 58 and effect a rebound force thereto after the percussion end 62 of the stem 60 has impacted solidly against the striking bar 63 as desired. The top chamber 68 is again connected to atmosphere at port 104 to vent therethrough. At the end of the downstroke, the connecting groove 92 is again in registry with the supply port 86 such that fluid under pressure is again supplied from delivery port 88 via connecting groove 92, supply port 86, port 85, groove 76 and port 84 to the lower chamber 64 to repeat the upstroke movement previously described.

From the foregoing description of up stroke and down stroke motion it can be seen that the drill hammer 36 (piston head 58 and stem 60) is reciprocated up and down with an impact blow occurring at the striking bar 63 on the downstroke to achieve the desired effect necessary in drilling operations of impacting the striking bar while rotating it by separate means. The air supply is direct from a single centrally located unitary connecting means or manifold via a very short path from the yoke 30 directly through the buffer ring 52 resulting in very little pressure drop in such a direct supply path therefore requiring a smaller supply of air than previous apparatus. It should also be noted that by going directly through the buffer ring 52 there is no longer the need for maintaining a lengthy supply path of fluid under pressure through the backhead and down through the cylinder and liner and thence to the buffer ring, thus the backhead may be easily removed for servicing the internal parts of the drill without the necessity of disconnecting the heavy, bulky hoses from the backhead as heretofore has been done.

Figure 5:
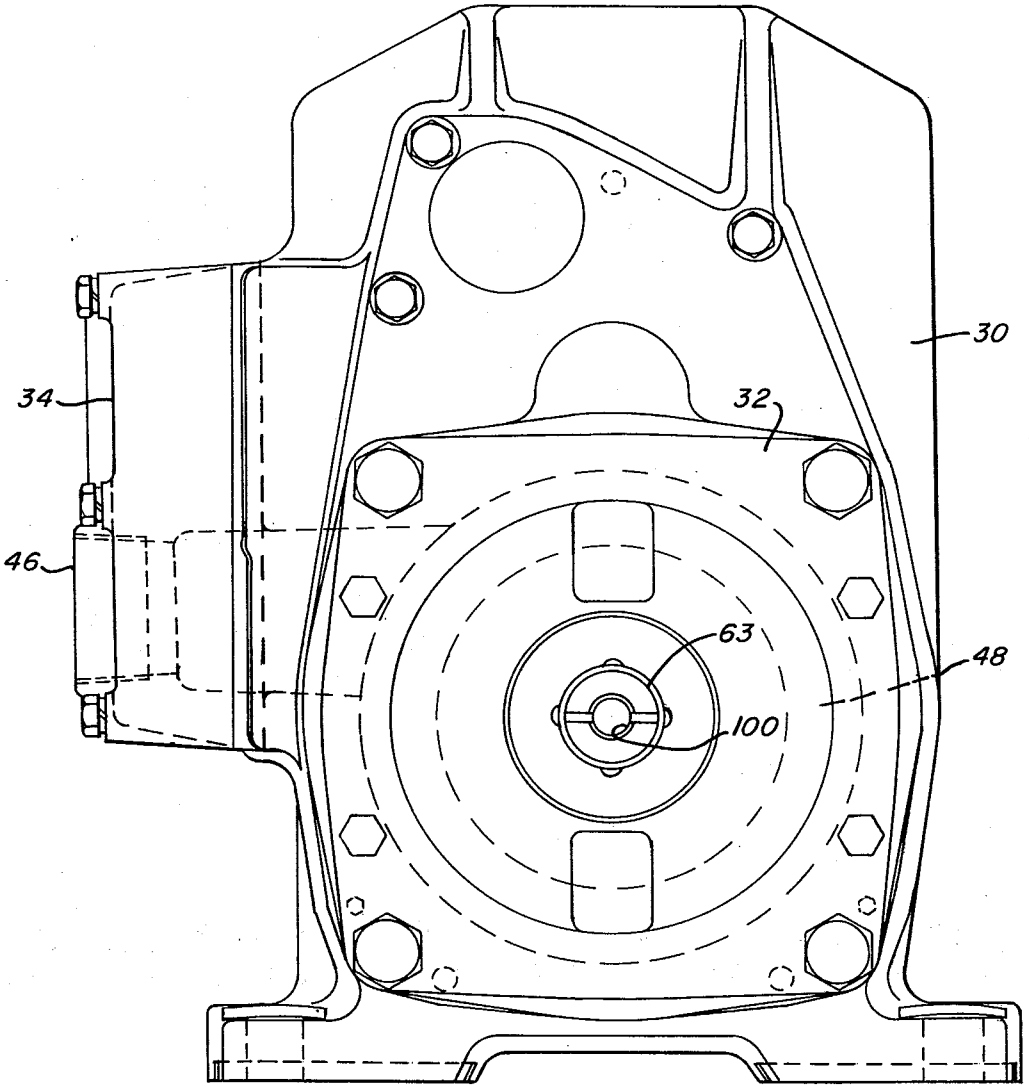
FIG. 5 is a bottom view of the drill assembly showing the manifold in dotted lines and the location of connected passages.

FIG. 5 shows the location of the manifold 34 on the apparatus and the manner in which the collector annulus 48 is positioned within the yoke 30.

Although I have shown and described only one embodiment of the present invention, different embodiments may be comprised of variations in the location of the manifold changes in port and passage sizes and locations and other groove locations, without departing from the spirit and scope of the invention and it is intended that all matter contained in the foregoing description and shown in the accompanying drawings shall be interpreted as illustrative and not in a limiting sense.

What is claimed is:

1. A fluid operated rock drill apparatus comprising: a housing including axially aligned backhead and yoke portions, and a cylinder portion located therebetween; said cylinder portion adapted to receive a reciprocable piston therein for delivering impact blows as such piston moves in the direction toward said yoke portion; delivery passage means in said cylinder portion for conveying a selectively controlled flow of pressurized fluid to reciprocate such piston; passageway means located in and externally accessible of said yoke portion; and said delivery passage means communicating with the exterior of said housing only through said passageway means whereby such flow of pressurized fluid is available for reciprocating such piston only through a source of pressurized fluid communicating with said passageway means.

2. An apparatus as specified in claim 1 additionally comprising: rotary fluid drive means in pressurized fluid communication with said yoke portion; and other passageway means located in and externally accessible of said yoke portion for communicating at least one other source of pressurized fluid from the exterior of said housing to said rotary fluid drive means.

3. An apparatus as specified in claim 2 additionally comprising: unitary fluid source connecting means independently and releasably secured to said yoke portion and being the sole connection of said first mentioned and other sources of pressurized fluid to said respective first mentioned and other passageway means.

4. An apparatus as specified in claim 2 wherein: said other passageway means includes two separate fluid passages respectively for communicating two other sources of pressurized fluid from the exterior of said housing to said rotary fluid drive means.

5. An apparatus as specified in claim 4 additionally comprising: unitary fluid source connecting means independently and releasably secured to said yoke portion and being the sole connection between said first mentioned source of pressurized fluid and said first mentioned passageway means, and between said two other sources of pressurized fluid and respective ones of said two separate fluid passage.

6. An apparatus as specified in claim 5 wherein said connecting means includes a member having three separate bores therethrough; one of said bores being in communication with said first passageway means and the other two of said bores being in respective communication with said two separate passages when said member is secured to said yoke portion.

7. An apparatus as specified in claim 4 wherein said rotary drive means includes first and second pressure hoses connected to respective ones of said two separate fluid passages.

8. An apparatus as specified in claim 1 wherein the selective controlling of such flow of fluid is by directing such fluid to opposite sides of such piston in response to the position of such piston in said cylinder portion.

9. An apparatus as specified in claim 1 wherein said first passageway means in said yoke portion includes a collector annulus in communication with said delivery passage means.

10. An apparatus as specified in claim 1 additionally comprising a container muffler surrounding said cylinder portion.

11. A fluid operated rock drill apparatus comprising: a housing including axially aligned backhead, cylinder, yoke and front-cap portions, said cylinder portion being adjacent said backhead portion and said yoke portion being intermediate said cylinder portion and said front-cap porton; said front-cap portion adapted to receive a striking bar therethrough, a hammer piston reciprocable within said cylinder portion in response to pressurized fluid being alternately directed from a delivery passage means in said cylinder portion to opposite sides of said hammer piston for delivering impact blows to such striking bar; a rotary fluid drive means in said housing for rotating such striking bar; first passageway means in said yoke portion for communicating a first source of pressurized fluid from the exterior of said housing to said delivery passage means for reciprocating said piston; second passageway means in said yoke portion for communicating at least one other source of pressurized fluid from the exterior of said housing to said rotary fluid drive means; and unitary connecting means independently and releasably secured to said yoke portion and being the sole connection of said first and other fluid sources to said respective first and second passageway means.

* * * * *